US007131753B1

(12) United States Patent
Edwards, Jr.

(10) Patent No.: US 7,131,753 B1
(45) Date of Patent: Nov. 7, 2006

(54) MULTI-ARM ADJUSTABLE FLUORESCENT LIGHTING FIXTURE

(75) Inventor: Richard D. Edwards, Jr., Warwick, RI (US)

(73) Assignee: Edwards Enterprises, LLC, Warwick, RI (US)

( * ) Notice: Subject to any disclaimer, the term of this patent is extended or adjusted under 35 U.S.C. 154(b) by 60 days.

(21) Appl. No.: 10/842,335

(22) Filed: May 10, 2004

(51) Int. Cl.
*F21S 8/06* (2006.01)
*F21S 4/00* (2006.01)

(52) U.S. Cl. ..... 362/405; 362/11; 362/220; 362/225; 362/239; 362/250

(58) Field of Classification Search ..... 362/238, 362/236, 239, 249, 250, 404, 405, 406, 428, 362/427
See application file for complete search history.

(56) References Cited

U.S. PATENT DOCUMENTS 4,803,606 A * 2/1989 Rotter ..... 362/250
5,072,341 A * 12/1991 Huang ..... 362/96
6,416,207 B1 * 7/2002 Chang ..... 362/419
6,886,968 B1 * 5/2005 Hamelink et al. ..... 362/485

* cited by examiner

*Primary Examiner*—Alan Cariaso
*Assistant Examiner*—Leah S. Lovell

(74) *Attorney, Agent, or Firm*—Cesari and McKenna, LLP; William A. Loginov

(57) ABSTRACT

This invention provides a high-output industrial light fixture that employs a plurality of commercially available fluorescent light sources in an array of adjustable arm assemblies each housing one or more light sources (fluorescent bulbs) in an associated reflector box or other source housing structure. By adjusting the arm assemblies, a more-precise spread of light onto the target surface can be achieved. Arm mounting brackets can be provided with one or more locking positions to facilitate multi-position angular placement of each individual arm. A plurality of arm assemblies can be provided around a center housing or hub, each directed outwardly in a radial direction from a central point or axis of the center housing/hub. Each arm's source reflector box/source housing structure can be located to project light either downwardly or upwardly and can be angled at a plurality of angular adjustment positions with respect to the center housing in each of the upward and/or downward positions. The bottom surface of center housing remains unobstructed (with arm assemblies extending away from it) so that cameras, sensors and other devices can be provided thereon. In an alternate embodiment, the reflector box/source housing structure for containing each light source can be mounted so as to extend transversely to a radial direction from the center. Accordingly, each box is located at a radial spacing from the center and extends substantially perpendicularly with respect to the radius, so as to define a polygon of reflector boxes around the center.

16 Claims, 12 Drawing Sheets

MULTI-ARM ADJUSTABLE FLUORESCENT LIGHTING FIXTURE

BACKGROUND OF THE INVENTION

1. Field of the Invention

This invention relates to industrial lighting and, more particularly, to high-output lighting fixtures using fluorescent lighting sources.

2. Background Information

High-output lighting fixtures are used in a variety of indoor and outdoor applications. Notably, a large unobstructed volume, such as a warehouse or indoor arena may employ a significant number of fixtures, which depend from the roof or supporting beams at predetermined spacing, in order to create a desired lighting effect. The fixtures often used for this purpose are metal-halide bulb fixtures, such as the exemplary fixture 100 shown in FIG. 1. Such metal-halide fixtures typically include a base 102 attached to one end of a chain or cable 104, with the chain's opposing end (not shown) secured to the building's roof or an associated support beam. The exemplary fixture base 102 includes a mounting socket 106 for a single large metal-halide bulb 110. This type of fixture may mount another high-output single bulb (rather than metal-halide) including a mercury vapor bulb or sodium bulb. Typically, the bulb 110 is encased within an open space 112 defined by a hemispherical (or other shape) shield or shade 114, having a lower end 120 that is open to allow light to escape. The inner surface 122 of the field may be reflective or transparent, depending upon the application. In general, the shape of the shield or shade 114 is designed to reflect the light generated by the bulb in a desired pattern onto the floor below.

Metal-halide, and similar types of single-bulb fixtures, exhibit certain performance characteristics. For example, they tend to have a relatively wide light distribution that, because of the fixed shade and single source, is not variable or directable. These bulbs also tend to create spots of light on the ground surface while areas between the fixture light spots may be darker. This leads to the so-called "cave effect." These lighting performance characteristics may, thus, provide a less-desirable lit space on which to conduct activities. In addition, metal-halide and other high-output bulbs or sources tend to generate substantial waste heat. This increases is a result of inefficiency in converting electric power to light, and where a large number of fixtures are employed, may actually serve as a significant heat source in the building volume (such heat increasing overall cooling costs and being particularly problematic in a cool environment such as an ice arena). Also, the excessive heat may eventually degrade the materials from which the fixture is constructed.

Furthermore, metal-halide bulbs or sources tend to exhibit weakened output after approximately one month of use. This leads to even lower efficiencies and even higher electric consumption for such fixtures. In addition, metal-halide bulbs require substantial warm-up time to attain full brightness. Again, this increases consumption by requiring lights to be activated a significant time before they are actually needed and/or is otherwise inconvenient, as lights are not available on demand.

Finally, metal-halide bulbs, and other commercial, high-output incandescent light sources are plagued with significant color rendition problems. In essence, their output often exhibits a monotone/monochromatic color that washes out the target area in an "unnatural" hue. For example, a heavy orange or yellow tint may be present. In most instances a fuller-spectrum of light is highly desired.

It is therefore desirable to provide a light fixture that eliminates or reduces some or all of the disadvantages of metal-halide fixtures and those using similar bulb or source technologies.

SUMMARY OF THE INVENTION

This invention overcomes the disadvantages of the prior art by providing a high-output industrial light fixture that employs a plurality of commercially available fluorescent light sources in an array of adjustable arm assemblies each housing one or more light sources (fluorescent bulbs) in an associated reflector box or other source housing structure. By adjusting the arm assemblies, a more-precise spread of light onto the target surface can be achieved. Arm mounting brackets can be provided with adjustment mechanisms that enable one or more locking positions to facilitate multi-position angular placement of each individual arm. The commercially available fluorescent sources/bulbs employed by this invention use substantially less energy than a conventional metal-halide sources, operate at a much cooler temperature and provide a light that is significantly closer to full-spectrum over a long useful life.

In an illustrative embodiment, a plurality of arm assemblies can be provided around a center housing or hub, each directed outwardly in a radial direction from a central point or axis of the center housing/hub. Each arm's source reflector box/source housing structure can be located to project light either downwardly or upwardly and can be angled at a plurality of angular adjustment positions with respect to the center housing in each of the upward and/or downward positions. In an illustrative embodiment, the bottom surface of center housing remains unobstructed (with arm assemblies extending away from it) so that cameras, sensors and other devices can be provided thereon. In an illustrative embodiment, the light sources can be 22½-inch compact fluorescent bulbs having a U-shaped form. Alternatively, conventional linear fluorescent bulbs can be provided. The ballast for each source can be located within the arm in which it is mounted. Alternatively, ballasts can be located within the center housing or elsewhere in communication with the fixture.

In an alternate embodiment, the reflector box/source housing structure for containing each light source can be mounted so as to extend transversely to a radial direction from the center. Accordingly, each box is located at a radial spacing from the center and extends substantially perpendicularly with respect to the radius, so as to define a polygon of reflector boxes around the center.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
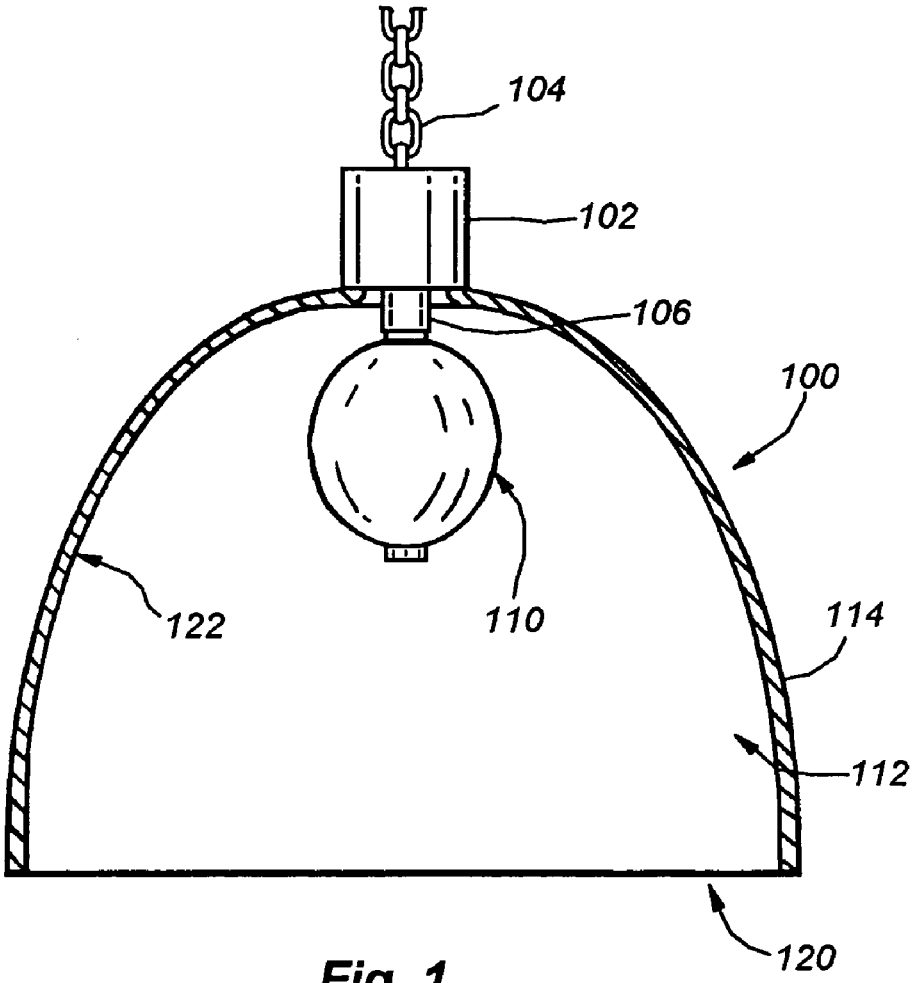
Fig. 1 (PRIOR ART)
FIG. 1, already described, is a cutaway side view of a conventional metal-halide fixture according to the prior art.
Figure 2:
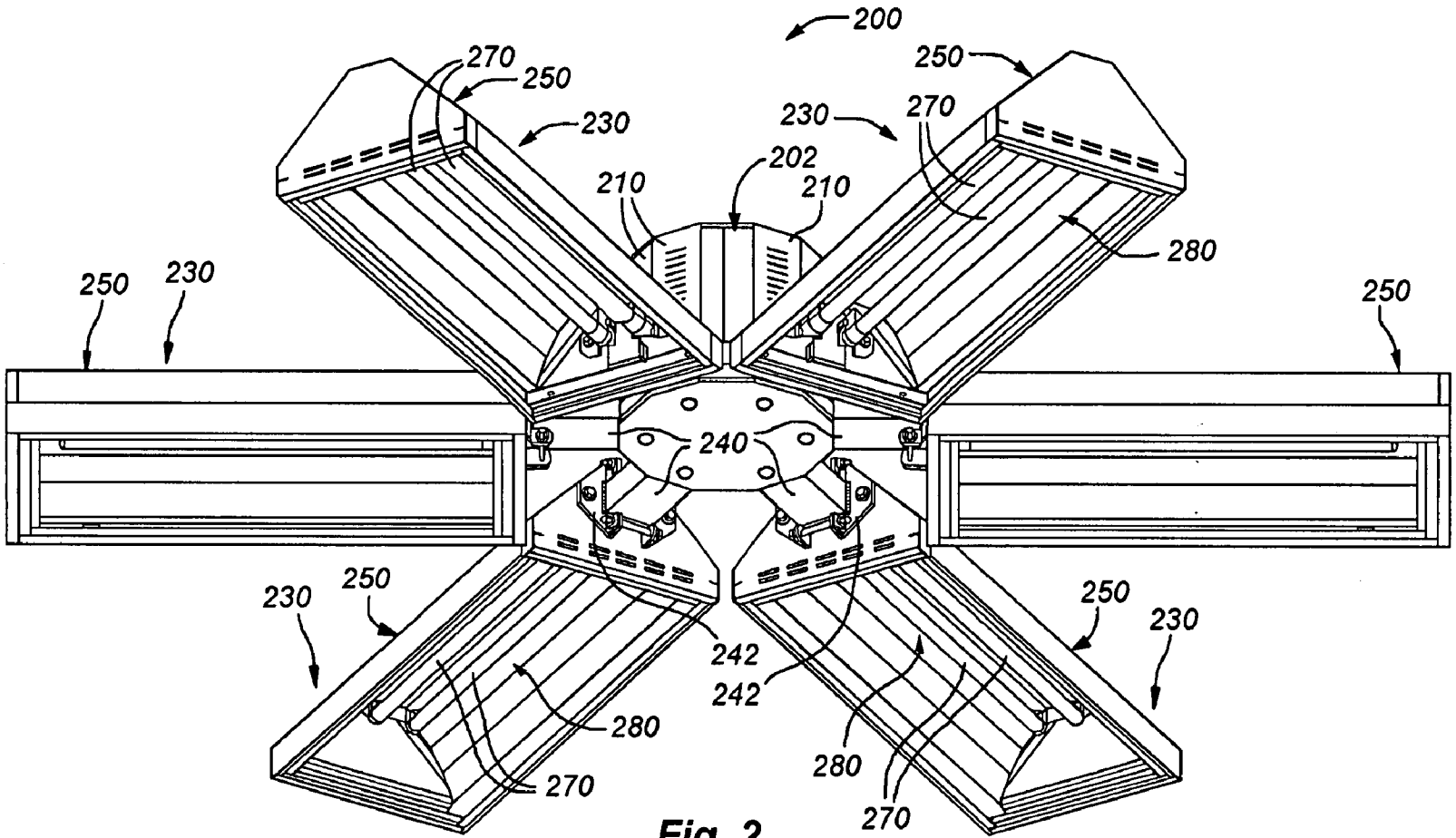
FIG. 2 is a bottom isometric view of a high-output, multi-arm, adjustable lighting fixture according to an embodiment of this invention.

FIG. 2 shows an adjustable, high-output, multi-arm, industrial lighting fixture 200 according to an embodiment of this invention. The fixture 200 consists of a center housing 202 that is shown in greater detail in FIG. 3. The center housing 202 includes a mounting hook 204 adjacent a center point or axis 205 along its top surface 206. The hook 204 can be interconnected with a conventional chain or cable (not shown) for mounting to a ceiling or supporting beam, as required. An appropriate power cable (also not shown) can travel along this chain from the top 206 of the center housing 202 to a junction box in the building. The center housing 202 is constructed from conventional sheet metal having a thickness of between approximately 1/32 and /1;8 inch in typical embodiments. However, size and strength dictate the exact thickness of the metal or other sheet material (plastic, for example) used in connection with the fixture of this invention. The side walls of the center housing 202 are constructed as a series of adjoining plates 210. While not required, the top 206 and sides can include vent slots 212 and 214 as shown. In general, the interior volume of the center is mostly hollow, but may include cross supporting beams as needed. Thus, structural integrity for the center housing 202 is provided by the outer sheet material with inner and outer reinforcing bands or frame members as needed. While a center housing that defines a box-like enclosure is shown, it is expressly contemplated that a sold or beam-like "center hub" structure can be substituted in alternate embodiments. The structure need only provide a useable center mounting point for the arm assemblies (230) and associated mounting bracket assemblies (240) to be described below.

Power cables or wires (not shown) can be distributed from a central power cable in the housing distributed throughout a multiplicity of arm assemblies 230 that each extend radially from the center point or axis 205 of the fixture. In this embodiment, there are provided six arm assemblies that each extend radially (along respective radial axes 338) from the center 205. The precise number of radial arm assemblies is highly variable and depends upon the size, shape and application of the fixture 200, as will be described further below. Each arm assembly 230 consists of a mounting bracket assembly 240 that is mounted to the outer wall of the center 202. The bracket assembly extends radially to a bracket flange 242 that provides a mounting base for a fixture reflector box (or other acceptable reflective or non-reflective light source housing structure or mounting support) 250 according to an embodiment of this invention. Each reflector box, in this embodiment, extends radially (along a radial axis 380) from its respective mounting flange 242.

The exemplary reflector box 250 is constructed from sheet material (e.g. sheet steel, etc.) in an appropriate gauge to maintain structural integrity under expected use and conditions. In this embodiment, each reflector box 250 has a cross-sectional shape (see the typical outline of box end 252) that is an isosceles triangle with transversely truncated corners. The cross-sectional shape of the box is highly variable in alternate embodiments. In general, this shape allows mounting of at least two linear fluorescent light sources 270 that, in this embodiment, each comprise a U-shaped compact fluorescent bulb having a conventional length of approximately 22½ inch and a mounting plug/socket arrangement at one end of the reflector box 250 (at the inboard end, adjacent the mounting bracket assembly 240 in this embodiment). Above the bulbs 270 are positioned reflector surfaces 280 that assist in directing the light of the bulbs 270 at an appropriate spread. A variety of conventional and/or novel surface shapes can be provided for the reflector surfaces 280 to enhance light spread and/or focus.

Figure 4:
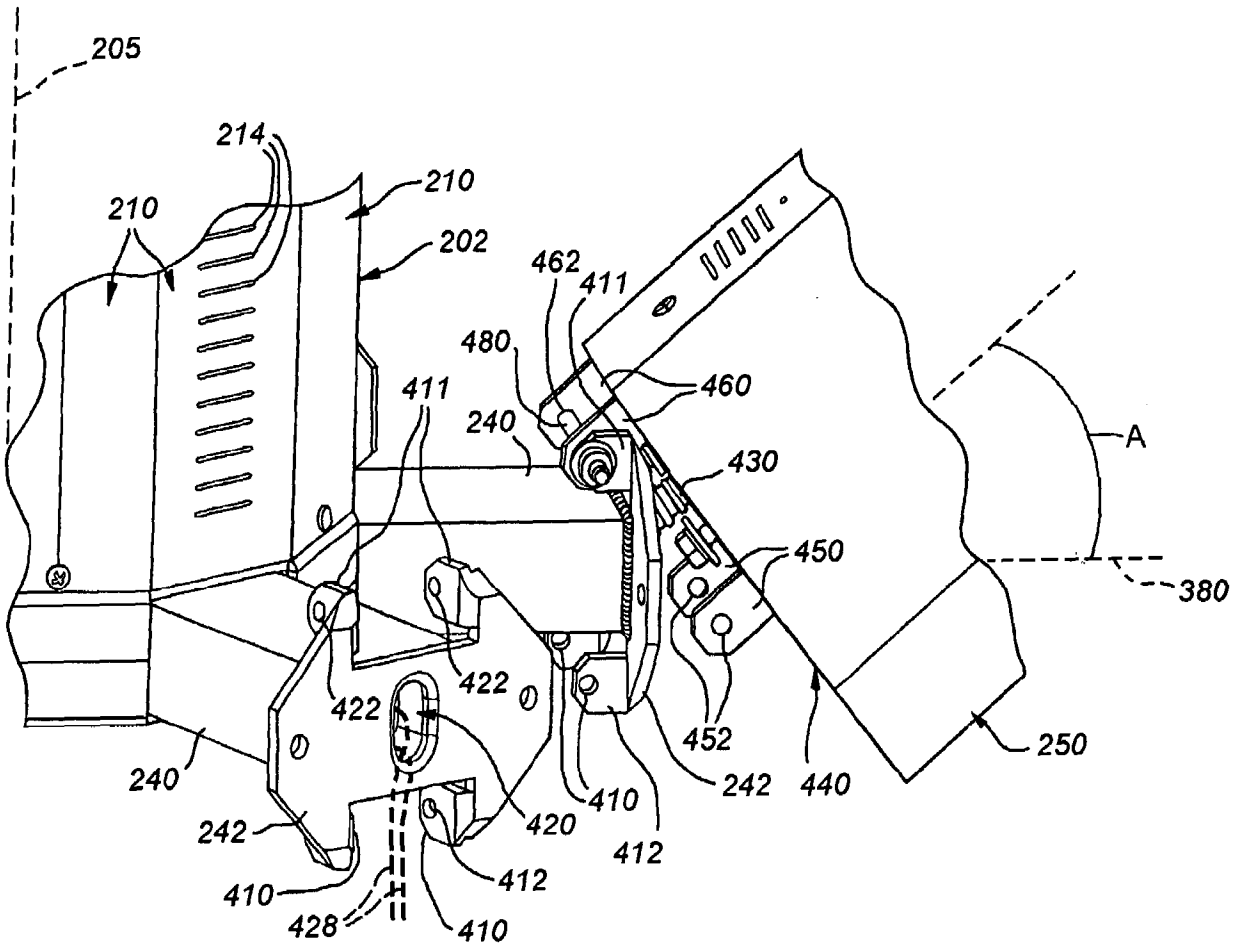
FIG. 4 is a fragmentary isometric view of mounting brackets extending from the center of the fixture of FIG. 2.

The fixture's mounting bracket assembly 240 is shown in further detail in FIG. 4. The flange 242 at the end of the bracket assembly 240 consists of a heavy-gauge sheet material piece (/1;8–/1;4 inch thickness, for example), having lower bracket plates 410 and upper bracket plates 411 extending rearwardly (towards the center axis 205) at right angles to the plane of the flange plate 242. The middle of the flange 242 includes an orifice 420 through which wires 428 (shown in phantom) can pass from the interior space of the center housing 202 to feed power to the light sources of the respective reflector box. An armored cable conduit 430 is also shown extending from the back face 440 of the reflector box 250 that protects these wires from fraying and exposure.

The flange 242 and back face 440 together define an adjustment mechanism that allows each reflector box 250 to be located adjustably at a plurality of variable adjustment locations with respect to the center housing/hub 202 and associated axis 205. The back face 440 of the reflector box 250 includes opposing pairs of locking (L-shaped) bracket plates 450 and 460 at the back face's bottom and top ends, respectively. The bracket plates 450 and 460 include holes 452 and 462 (respectively). The holes 452 of bracket plates 450 align holes 412 of bracket plates 410. Likewise the holes 462 of bracket plates 460 align with the holes 422 of bracket plates 411. As shown a bolt or pin 480 is passed through the aligned upper holes 422 and 462, thereby partially (and rotatably) securing the reflector box 250 to the mounting bracket assembly 240.

Figure 3:
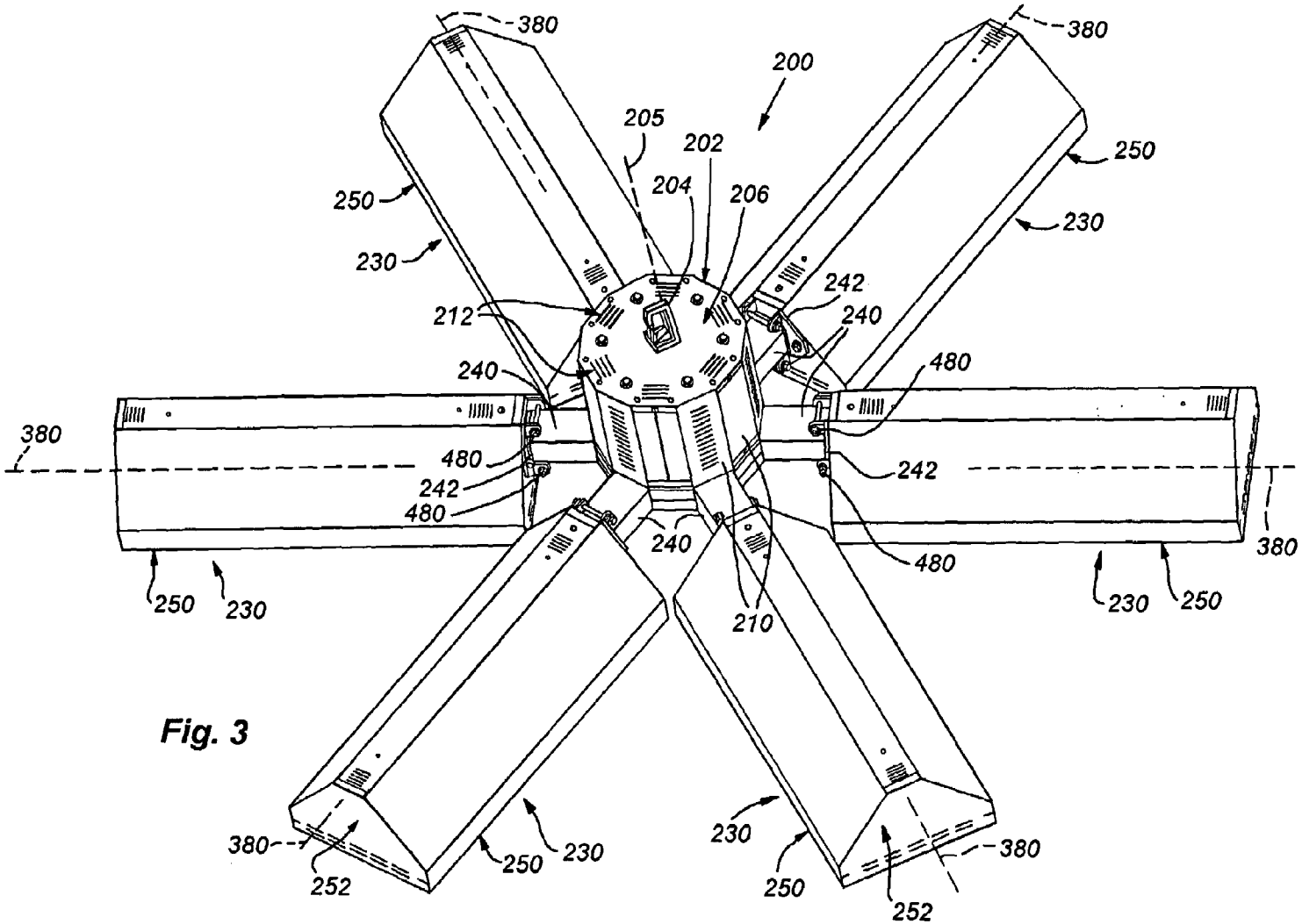
FIG. 3 is a top isometric view of the fixture of FIG. 2.

Given the upper and lower aligned sets of bracket plates (410, 450 and 411, 460), in a basic radial mounting arrangement, the reflector box 250 can secured with a pair of through-bolts 480 at its top and bottom as shown in FIGS. 2 and 3. In this arrangement, each reflector box extends directly along the radial axis 380 from the center 205 as shown. However, the opposing pairs of bracket plates (410, 450 and 411, 460) alternatively allow for securing on only a single set of brackets (410, 450 or 411, 460), thereby permitting the box to be pivoted downwardly or upwardly (as shown particularly in FIG. 4) at an angle A away from the radial axis 380. By fixing the reflector box in such an angled position, a high degree of adjustability to the direction of projected light can be attained.

Figure 5:
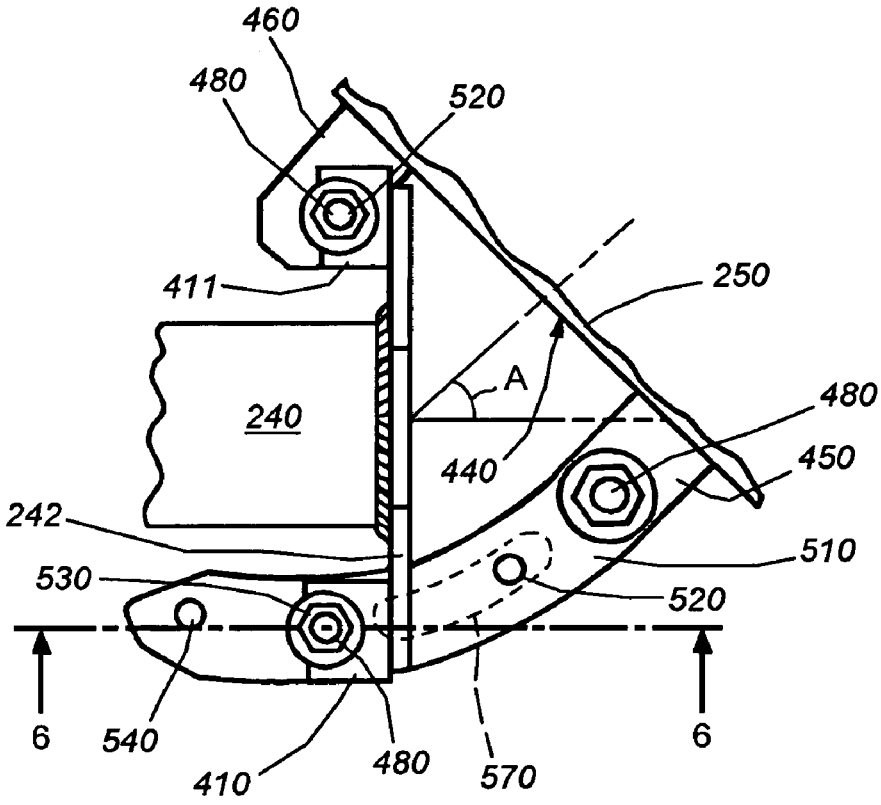
FIG. 5 is a fragmentary side view of a mounting bracket and reflector box in accordance with FIG. 4.
Figure 6:
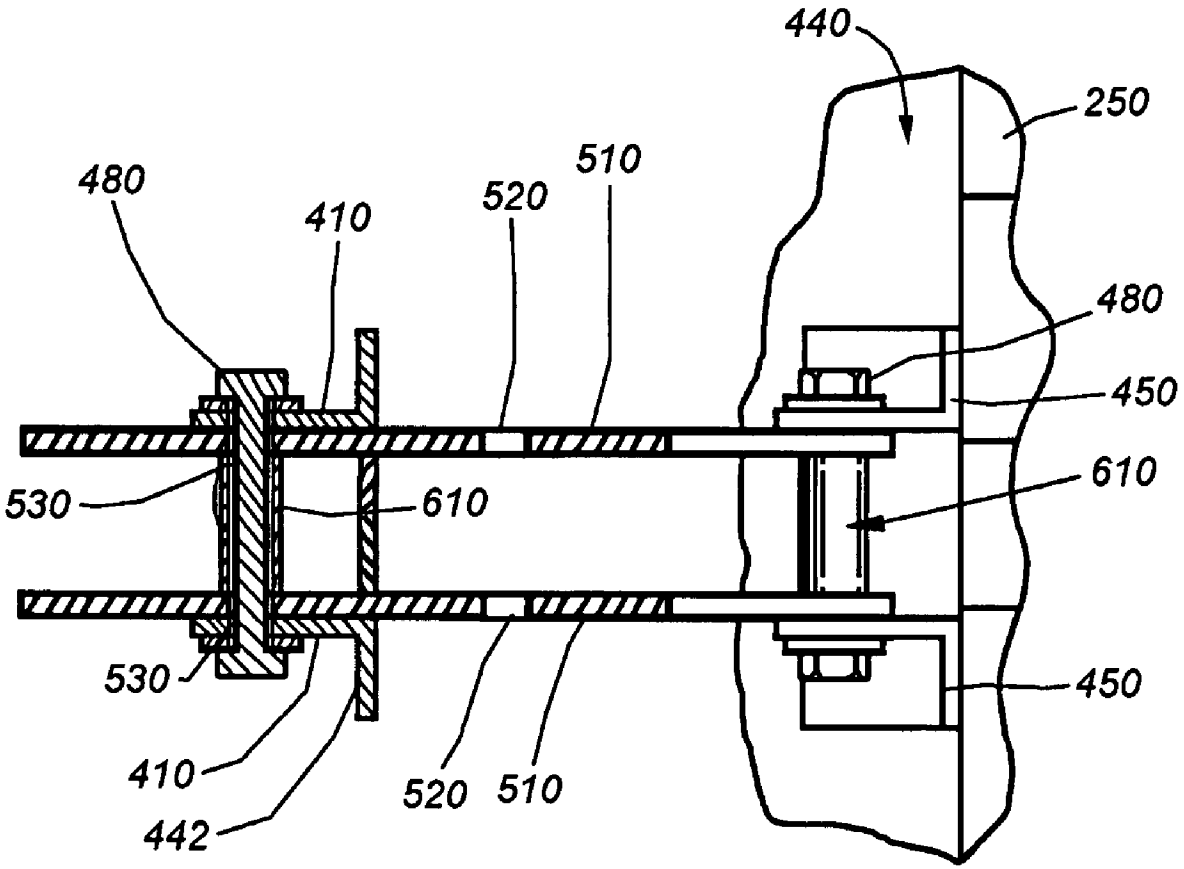
FIG. 6 is a top cross section view of the mounting bracket and reflector box taken along line 6—6 of FIG. 5.

Accordingly, with further reference to FIGS. 5 and 6, an arcuate adjustment bracket 510 is provided to maintain the reflector box 250 at the desired angle A. In general, one set of bracket plates (460, in this example) of the reflector box 250 are affixed by a bolt or pin 480 to the flange brackets (411 in this example) to create rotational a hinge point. The opposing bracket plates 450 of the reflector box 250 are spaced away from their corresponding flange brackets 410 through a pivoting action about the center point 520 formed at the upper bracket plates 411, 460. The ends of a pair of arcuate adjustment brackets 510 are bolted to the lower bracket plates 450 of the reflector box. The adjustment brackets 510 each include a set of adjustment holes 520, 530 and 540 (note that the actual number of holes is highly variable and can range along at least a 90-degree adjustment arc). The adjustment holes 520, 530, 540 enable the lower bolt 480 to be passed through the lower bracket plates 410 to lock the appropriate adjustment hole into position with respect to the flange 242. Accordingly, the desired angle A is maintained. Note further that a spacer 610 (FIG. 6) can be provided to each bolt 480 to maintain an appropriate spacing between opposing adjustment brackets 510. The spacer is a sleeve that fits over the bolt 480 during assembly of the bracket arrangement and it maintains the adjustment brackets 510 in close contact with their respective brackets 410 and 450. In this example, the ends of the adjustment brackets 510 are bolted to the reflector box' bracket plates 450 while the bracket adjustment holes 520, 530, 540 are freely moved to attain the appropriate adjustment location with respect to the flange's bracket plates 410. It is contemplated that the plates 410 can be alternatively fixed to ends of the brackets 510 while the adjustment holes 520, 530, 540 are variably located with respect to the reflector box' bracket plates 450. Likewise, while the adjustment brackets 510 define a series of spaced-apart adjustment holes, it is contemplated that, in alternate embodiments, the brackets can include continuous or semi-continuous slots (570 shown in phantom) through which the bolts 480 pass to provide a higher precision in the adjustability of the brackets 510. The term "holes" as used in this context should be taken broadly to include such slots.

Figure 7:
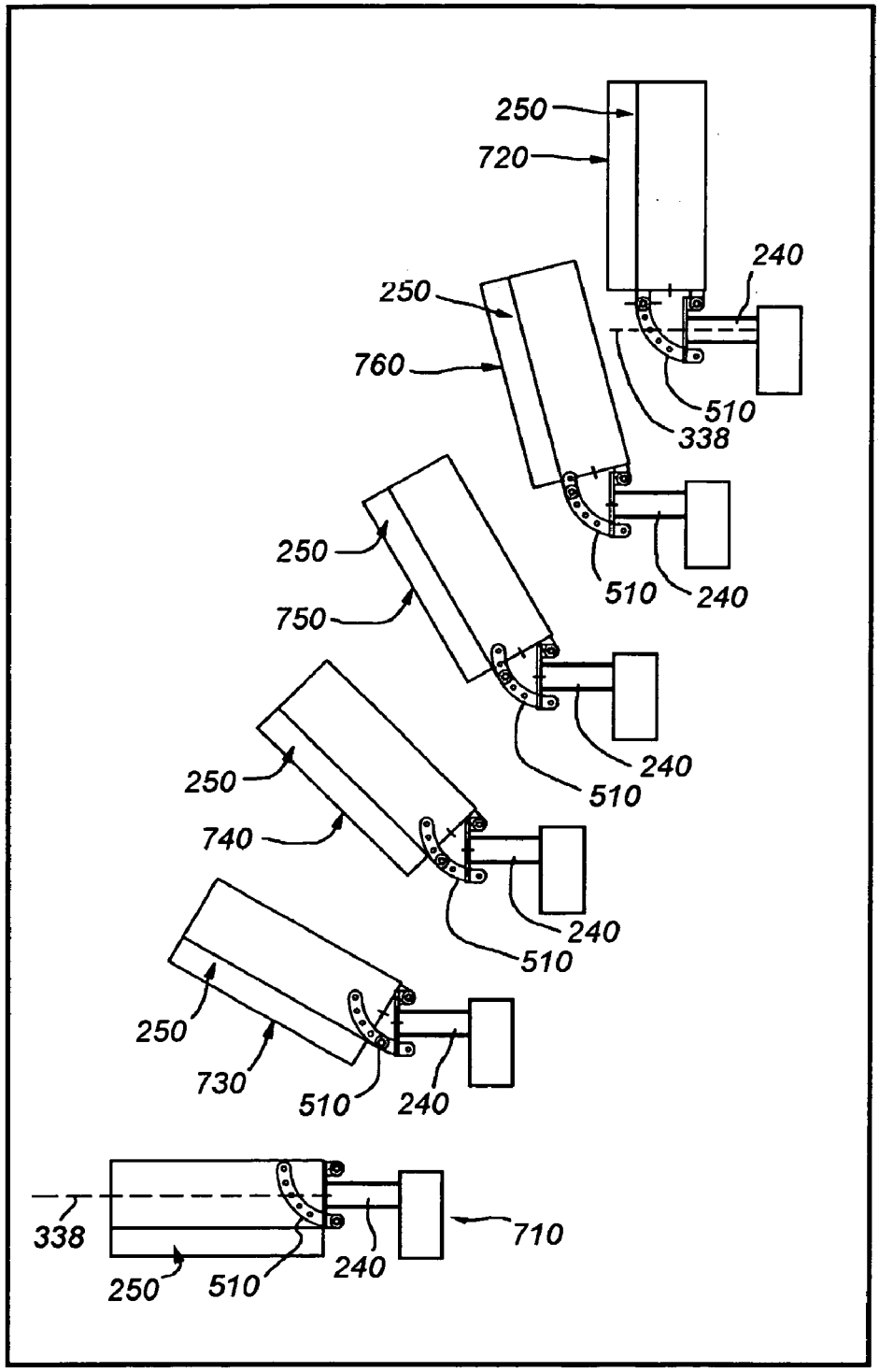
FIG. 7 is a somewhat schematic side view of the mounting bracket and reflector box assembly shown in each of a plurality of adjustment positions with the opening of the reflector box facing downwardly to produce a direct lighting effect.

It should be clear that the above-described adjustment bracket (510) arrangement allows each discrete arm assembly within the fixture to be angled to a plurality of (acute) angular positions. As shown in FIG. 7, these angular positions range between direct radially axially aligned position 710 through a perpendicular position 720 (at an approximate right angle to the radial axis 338) and the plurality of positions 730, 740, 750, 760 therebetween (various acute angles A described above). In the example of FIG. 7, the extension distance of the bracket 510 extends inwardly toward the reflector box 250 in accordance with the alternate arrangement discussed above. Again, the extension brackets can be arranged so that their extension projects either toward the center housing 202 or toward the reflector box 250.

Likewise, while FIG. 7 illustrates the reflector box in a plurality of angular positions between a downward directly radially axially aligned position (710) in which light is projected perpendicularly downwardly, and a perpendicular position (720), in which light is projected radially outwardly (along radial axis 338). Alternatively, it is contemplated that the lower bracket plates can be pivotally fixed to the mounting bracket assembly 240, and that one or more reflector boxes 250 can be angled so that their light is focused inwardly toward the center at any of a number of angular adjustment positions. Hence, the mounting arrangement, according to the illustrative embodiment of this invention, contemplate either the top or bottom bracket plates to be appropriately pivoted for maximum versatility along at least a 180 degree pivoting arc between a fully upwardly perpendicular orientation (720) and a fully downwardly perpendicular orientation (see such a downward/perpendicular orientation in, for example, FIG. 9, described further below).

Figure 8:
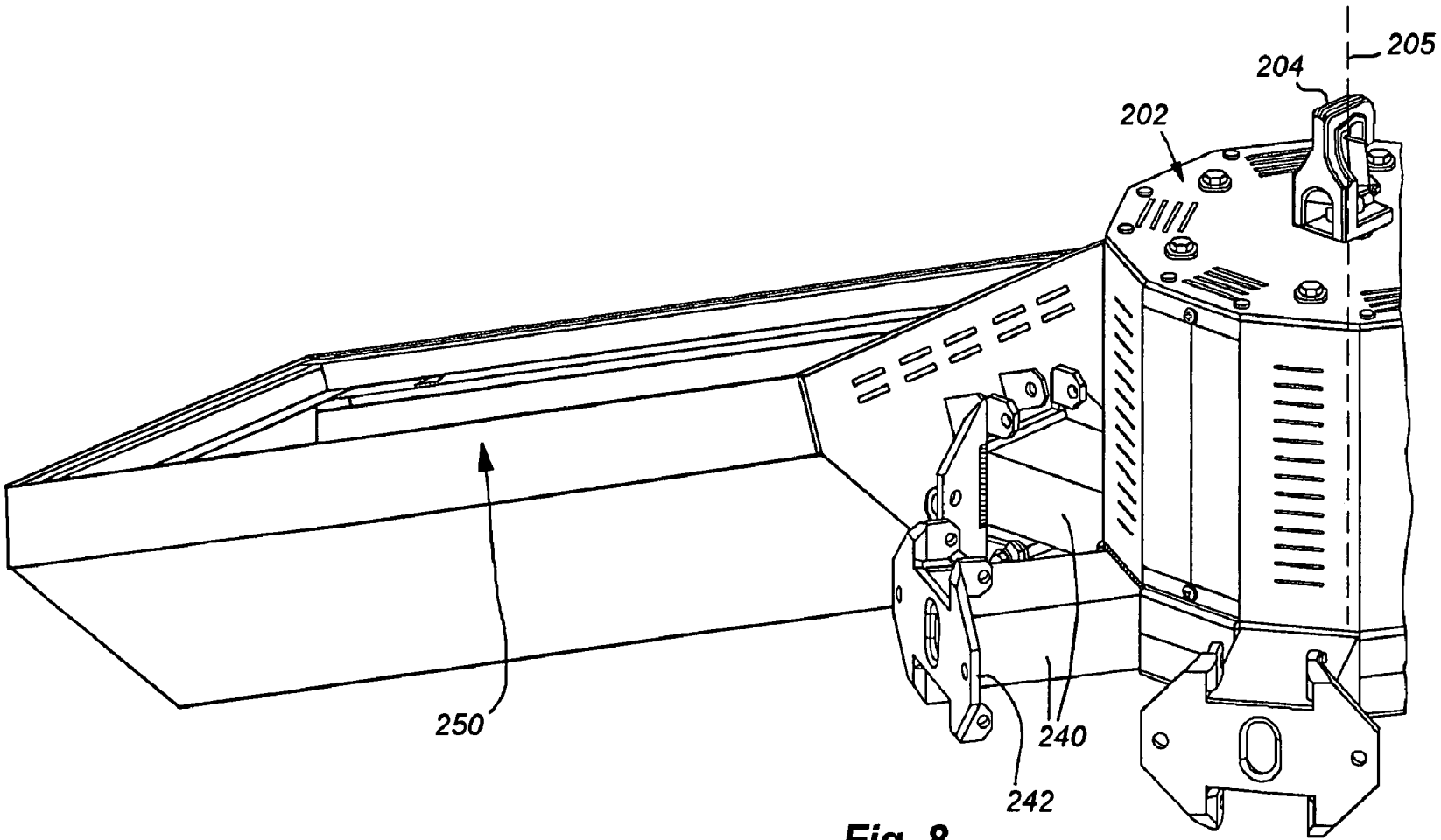
FIG. 8 is an isometric view of the center housing and reflector box assembly for the fixture of FIG. 2 showing the opening of the reflector box facing upwardly according to an alternate positioning.
Figure 9:
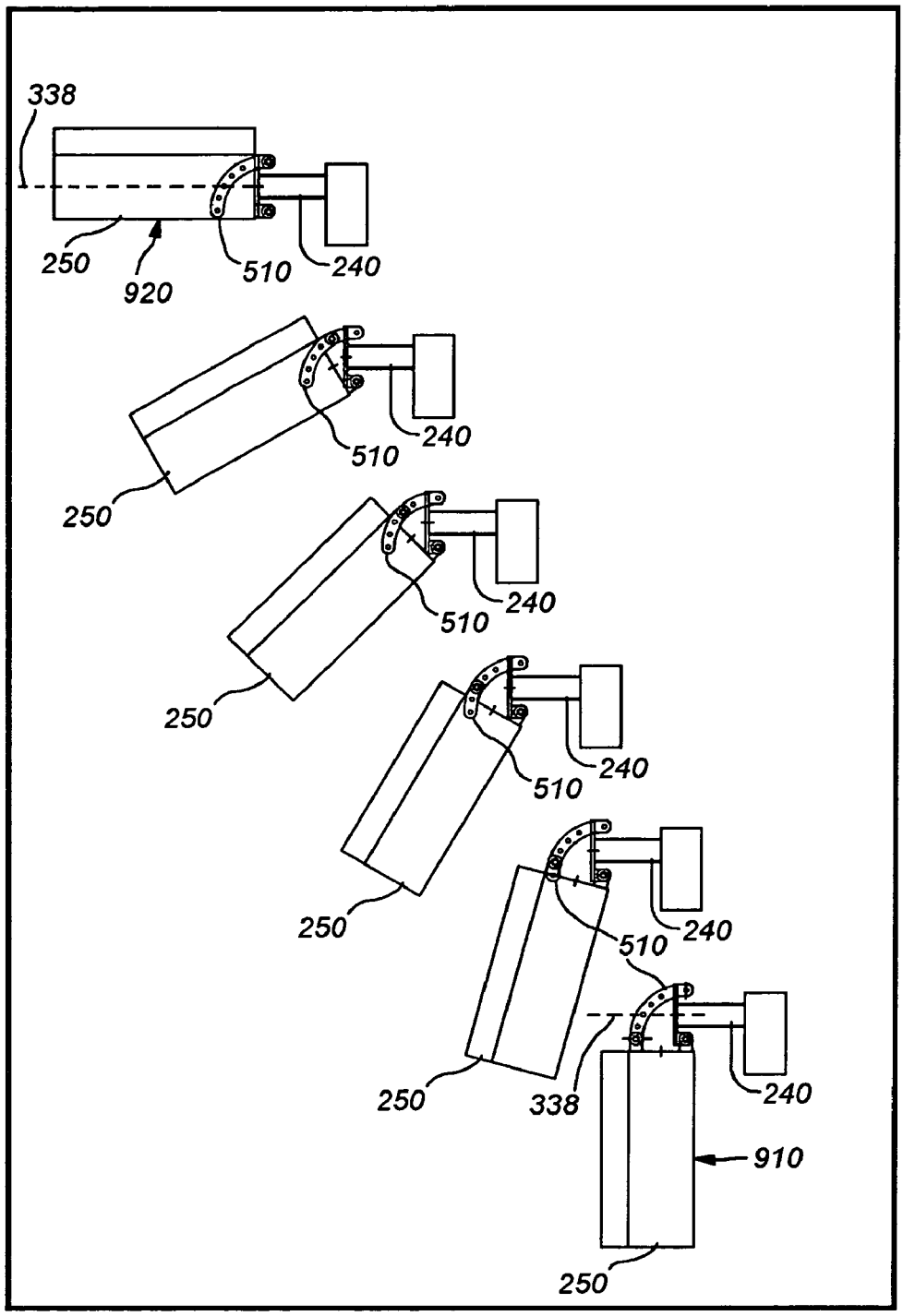
FIG. 9 is a somewhat schematic side view of the mounting bracket and reflector box assembly shown in each of a plurality of adjustment positions with the opening of the reflector box facing upwardly to produce an indirect lighting effect.

Due to the versatility of the mounting arrangement, as described above, one or more reflector boxes can be mounted so that their openings face upwardly, as shown in FIG. 8. Accordingly, the reflector box can be radially aligned, or angled, as described above, with its light projected upwardly to create an indirect lighting effect, which may be desirable in certain applications. As shown in FIG. 9, this orientation allows the light box to be positioned between a downwardly perpendicular orientation (910) and (at least) a radially axially directed orientation (920) as shown. A variety of angular positions therebetween can also be achieved by pinning the adjustment bracket 510 through the appropriate hole, as shown. As described generally above, the range of pivoting adjustment for the upwardly directed reflector box can be extended to a fully upwardly perpendicular (inwardly directed) orientation by moving the adjustment bracket to the lower bracket set and pivoting the reflector box about its upper brackets as shown generally in FIG. 7. Hence, in the upwardly directed orientation, the arms also have full adjustability throughout at least a 180-degree arc between a radially outwardly directed light and a radially inwardly directed light.

It should be clear that, according to any of the embodiments herein, reflector boxes may be provided variously to fewer that all of the mounting bracket assemblies. In other words, the number of reflector boxes may be reduced from a maximum number allowable to decrease the overall light provided by the fixture. This may be desirable where the light is positioned in corners or areas that are otherwise meant to be less well-lit. Reflector boxes may be located about the center in a manner that maintains desired balance. Of course, some arms may be angled at different angular adjustment positions than others to attain the desired spread of light, which may not be a perfect circle. The selective angling of light made possible by the lighting fixture according to this invention, allows uneven patterns of light to be achieved at the target surface. In further embodiments, some arms may be located upwardly for indirect lighting, while others may be located downwardly for direct lighting within the same fixture. For example, arms may alternate upwardly and downwardly so that three arms point downwardly and three arms point upwardly in an illustrative embodiment. Again, the exact number of arms that may be provided to a fixture is highly variable. In addition, different types of reflector boxes having differing reflector characteristics and/or different numbers of bulbs can be applied to different arm assemblies in the same fixture. In any case, a very high degree of versatility is provided by the fixtures in accordance with this invention.

Figure 10:
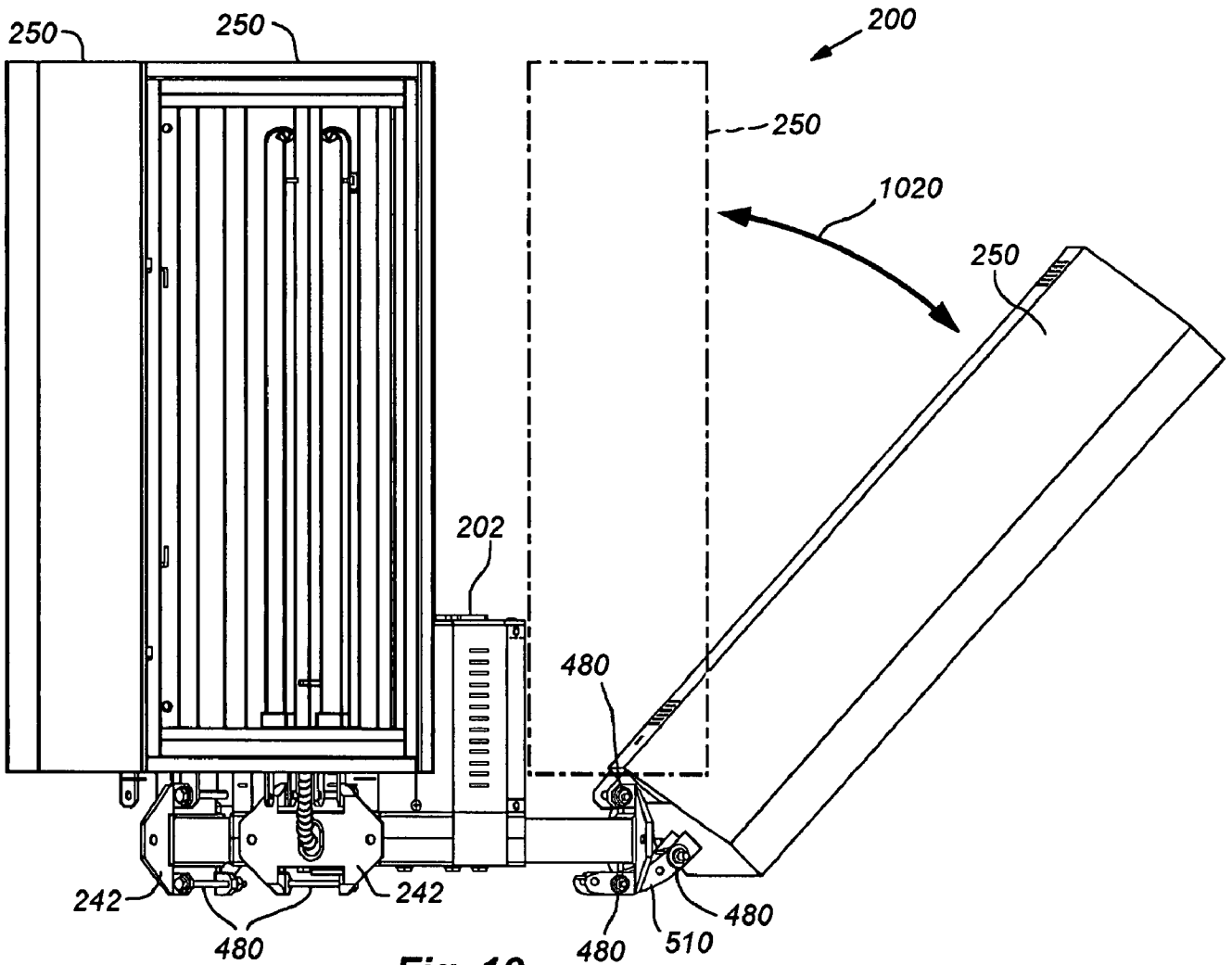
FIG. 10 is a side view of the fixture of FIG. 2 showing each reflector box in an upwardmost angular adjustment position.

In one such alternate arrangement, FIG. 10 shows generally the fixture 200 according to an illustrative embodiment of this invention with each of the reflector boxes 250 oriented in an upwardmost perpendicular position for storage or adjustment with one of the boxes (shown in phantom) being moved (double arrow 1020) to a final adjustment position with bolts 480 located through the appropriate holes on the adjustment bracket 510. Each reflector box 250 can be moved in turn to the desired angular position.

Figure 11:
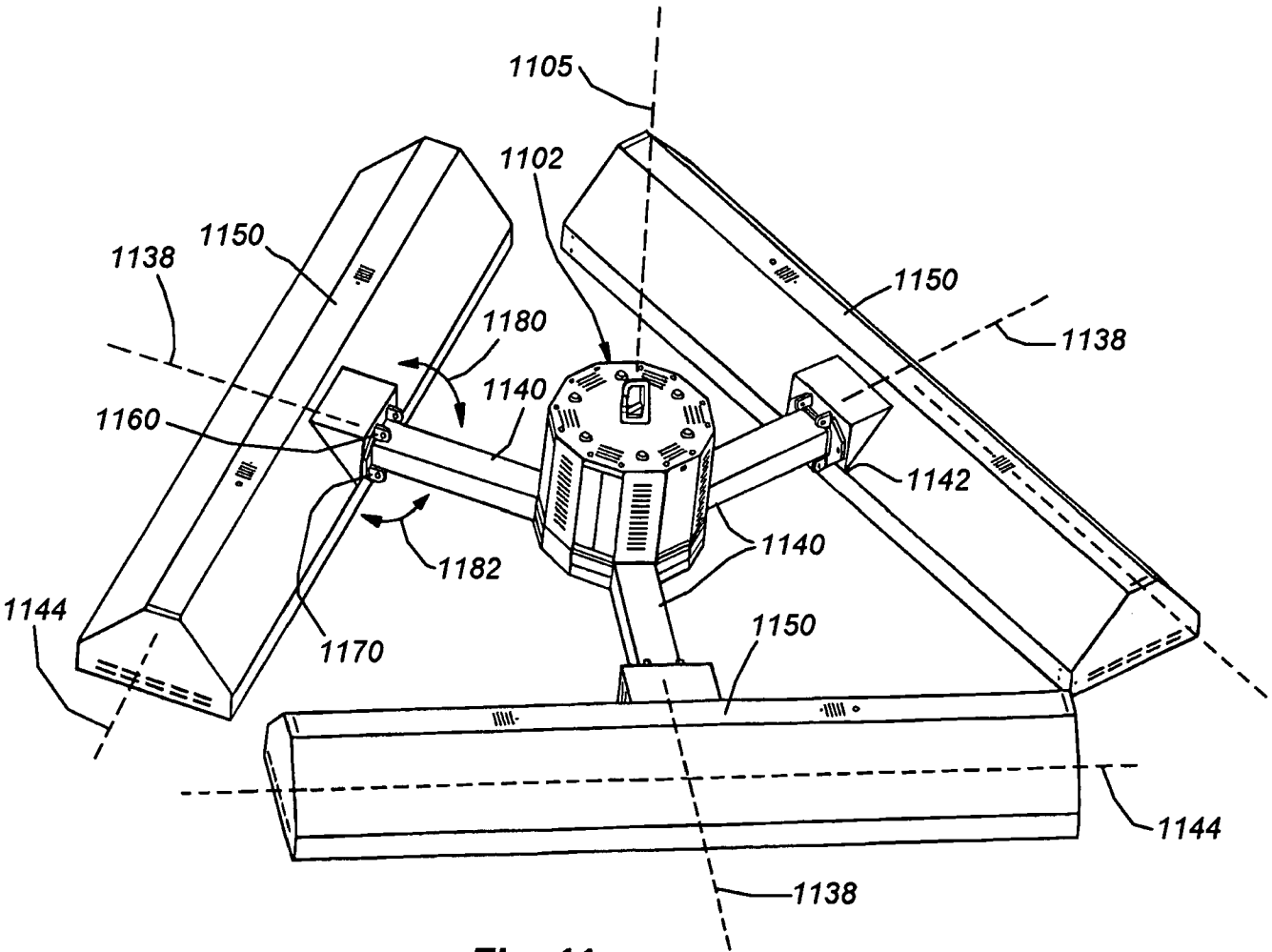
FIG. 11 is a top isometric view of a high-output, multi-arm, adjustable lighting fixture according to an alternate embodiment having radial arms, each with a reflector box transversely mounted to an end of the radial arm.

FIG. 11 shows an alternate embodiment of a high-output, multi-arm, adjustable light fixture in accordance with the general to the principles of this invention. The center housing or hub 1102 supports three mounting bracket assemblies 1140 in this example, each having a flange 1142 at its end. The flange 1142 is similar to the flange 242 described above with appropriate upper and lower bracket aligned plates on the flanges 1142 and reflector boxes 1150. Three reflector boxes 1150 are provided in this example. Each reflector box 1150 is oriented along an axis of extension 1144 that is approximately transverse (perpendicular) to the radial axis 1138 for each bracket assembly 1140, with respect to the center 1105 of the center housing 1102. The reflector boxes can be rotated on their bracket assemblies as shown by the pair of double arrows 1180 and 1182 along each of opposing sets of bracket plates (upper 1160 and lower 1170) so that the transverse-mounted reflector boxes can be angled to each of a number of angular positions with respect to the radial axis 1138. Likewise, the reflector boxes 1150 can be located in a downwardly direct position as shown, or, by flipping them, in an upwardly directed position.

In this embodiment, the axis of extension 1144 of each reflector box 1150 defines as a side of a polygon. The number of boxes may be limited, as their distance of extension is (typically) no longer than that which would cause them to contact the adjacent reflector box. By extending the length of each bracket assembly 1140, and/or by shortening the length of the boxes, the number of reflector boxes in a given fixture can be increased.

Figure 12:
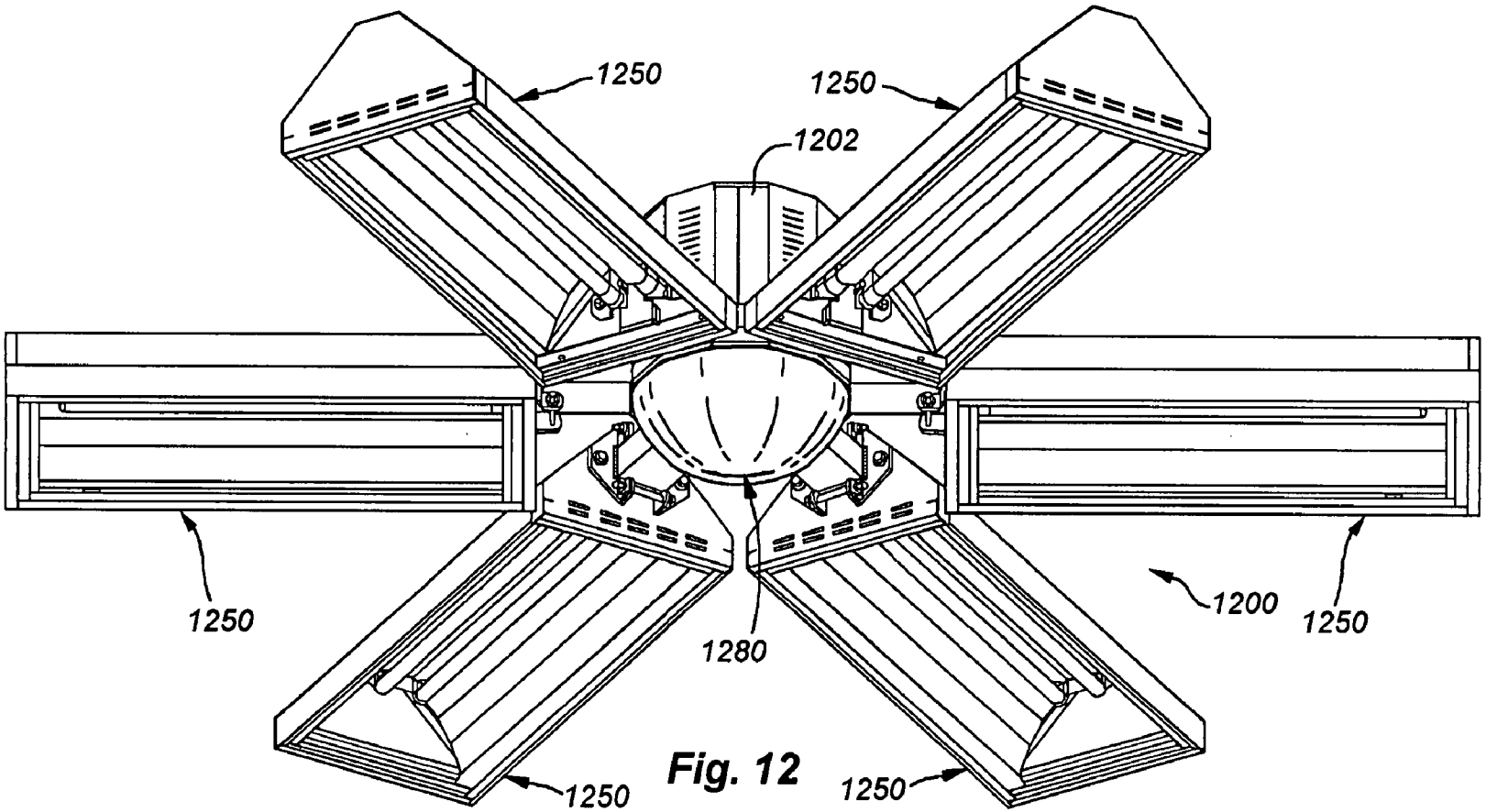
FIG. 12 is a bottom isometric view of a high-output, multi-arm, adjustable lighting fixture according to an illustrative embodiment including a center-mounted sensor dome.

Finally, a further modification of the fixture 200 is shown in FIG. 12 as fixture 1200. This fixture includes a center housing or hub 1202 and a set of mounted reflector boxes 1250 that are similar in adjustment and mounting to those described with reference to FIG. 2, et seq. Because of the relatively unobstructed view of the center's bottom, a sensor, camera or other remote device (shown as exemplary dome 1280) can be provided to the center housing 1202. Such a device can include, but is not limited to, any or all of a camera, microphone, smoke detector, temperature sensor, or any number of components that may be desirable to deploy within the particular space being lit. A camera and/or temperature detector are particularly desirable in an arena where the light fixture can also act as a climate control element and/or permanent viewing port for television and large-screen displays. Where the center housing 1202 is largely hollow, further equipment or electronics can be recessed thereinto. In one embodiment, the housing can be sold commercially with a variety of optional bases that support desired devices.

The foregoing has been a detailed description of illustrative embodiments of this invention. Various modifications and additions can be made without departing from the spirit and scope thereof. For example, the size and shape of reflector boxes is highly variable, as are the types of bulbs mounted therein. While linear bulbs are shown, reflector boxes or other housings/supports can define a variety of shapes including ovular, circular and the like and can support bulbs or other light sources having non-linear, or curvilinear, outline shapes. While fluorescent bulbs may be used in one example, it is contemplated that light sources constructed from other advanced technologies, including light emitting diodes, may be substituted. Bars of light emitting diodes may be substituted. While a current source in a remote location is provided in one embodiment, it is contemplated that the light fixture may include a backup power source or a full-time self-contained power source such as a battery or solar cell. Likewise, the shape of the center housing is highly variable, as is the technique in which mounting bracket assemblies are secured to the center housing. Finally, while a reflector box, having a reflector, is shown and described, it is expressly contemplated that the term "reflector box" as described herein can include housing structures or mounting supports for light sources structures that may not enclose the light source and/or may facilitate projection of only a direct light from a source (such as an LED panel) to a surface to be lit (with no "reflector" function). Accordingly, this description is meant to be taken only by way of example and not to otherwise limit the scope of the invention.

What is claimed is:

1. A light fixture comprising:

a center hub having a hub axis and including a mounting hook constructed and arranged to suspend the hub with respect to a ceiling;

mounting bracket assemblies attached to the center hub;

a plurality of light source support structures, each of the light source support structures comprising a reflector housing that includes therein a light source, comprising a fluorescent tube, the light source support structures each defining a support structure axis of extension and each of the light sources being constructed and arranged to project a light toward a portion of a target surface opposite the ceiling; and a respective adjustment mechanism that comprises a hinge pin attached to each of the mounting bracket assemblies and reflector housing, respectively, being constructed and arranged to allow each reflector housing to be adjustably located at each of a plurality of angular positions with respect to the center hub and a locking assembly that maintains each of the plurality of angular positions so as to vary a resulting spread of light at the target surface.

2. The light fixture as set forth in claim 1 wherein the plurality of adjustment positions include a plurality of angular positions between each axis of extension and the hub axis, each of the angular positions being maintained by securing a bolt of the locking assembly with respect to a curved slot of the locking assembly.

3. The lighting fixture as set forth in claim 2 wherein each of the mounting bracket assemblies extends along a respective radial axis away from the hub axis and each of the light source support structures is mounted with respect to the mounting bracket assemblies so that the respective axis of extension thereof extends approximately transversely to the respective radial axis.

4. The lighting fixture as set forth in claim 1 wherein each reflector housing is elongated along the axis of extension and is adjustable to each of a plurality of the angular positions between a directly radial position perpendicular to the hub axis and an approximately perpendicular position perpendicular to a directly radial axis from the hub axis.

5. The lighting fixture as set forth in claim 1 wherein the light source support structures are adjustably positioned in each of a downward and an upward direction respectively with respect to the center hub.

6. The lighting fixture as set forth in claim 5 wherein the mounting bracket assemblies each include opposing pairs of bracket plates, each of the bracket plates having mounting holes, and wherein the light source support structures are each mounted so as to pivot on either of the opposing pairs of bracket plates.

7. The lighting fixture as set forth in claim 6 further comprising an adjustment bracket assembly that allows at least one pair of bracket plates to be spaced with respect to another pair so as to pivot the reflector housing into an angled orientation with respect to the hub axis and a respective radial axis perpendicular to the hub axis.

8. The lighting fixture as set forth in claim 7 wherein the adjustment bracket assembly includes a plurality of adjustment locations that allow the bracket assembly to be pinned to the other pair of bracket plates at each of the plurality of angular positions.

9. The lighting fixture as set forth in claim 1 wherein the center hub comprises a housing having a bottom side that includes a sensing device thereon.

10. The lighting fixture as set forth in claim 9 wherein the sensing device comprises a camera.

11. The lighting fixture as set forth in claim 1 wherein each of the mounting bracket assemblies is adapted to variably connect to and to be disconnected from a light source support structure so that a total number of light source support structures attached to the lighting fixture can be varied between a maximum number and a number less than the maximum number.

12. The lighting fixture as set forth in claim 1 wherein the adjustment mechanism is adapted to allow a first set of the lighting support structures on the lighting fixture to be directed to project light upwardly and a second set of the lighting support structures on the lighting fixture to be directed downwardly.

13. The lighting fixture as set forth in claim 12 wherein the adjustment mechanism is adapted to allow the respective axis of extension of each of the first set of light source support structures to be located at each of a plurality of angular positions with respect to the hub axis and to allow the respective axis of extension of each of the second set of light source support structures to be located at each of a plurality of angular positions with respect to the hub axis.

14. The lighting fixture as set forth in claim 1 wherein the adjustment mechanism includes a flange on an end of each of the mounting bracket assemblies having a lower flange bracket plate assembly and an upper flange bracket plate assembly and a lower light source support bracket plate assembly and an upper light source support bracket plate assembly on an end of each of the light source support structures, wherein at least one of either the lower flange bracket plate assembly and lower light source support bracket plate assembly or the upper flange bracket plate assembly and upper light source support bracket plate assembly can be pinned together to respectively allow the light source support structures to rotate with respect to the mounting bracket assemblies.

15. The lighting fixture as set forth in claim 14 further comprising an adjustment bracket assembly that fixedly spaces apart one of the either the lower flange bracket plate assembly and lower light source support bracket plate assembly or the upper flange bracket plate assembly and upper light source support bracket plate assembly to respectively fix the light source support structures so that each respective axis of extension is located at one of a plurality of angular positions with respect to the hub axis.

16. The lighting fixture as set forth in claim 1 wherein the hub is positioned in a downward direction from a hanging support and wherein at least one of the light source support structures is oriented so as to direct light approximately upwardly, opposite the downward direction.

* * * * *